US005605760A

United States Patent [19]

Roberts

[11] Patent Number: 5,605,760

[45] Date of Patent: Feb. 25, 1997

[54] POLISHING PADS

[75] Inventor: John V. H. Roberts, Newark, Del.

[73] Assignee: Rodel, Inc., Newark, Del.

[21] Appl. No.: 517,578

[22] Filed: Aug. 21, 1995

[51] Int. Cl.[6] ..... B24B 1/00; B24B 3/60; B24B 29/00; B32B 33/00

[52] U.S. Cl. ..... 428/409; 51/298; 364/474.06; 437/225; 451/41; 451/527; 451/533; 216/52

[58] Field of Search ..... 428/409; 51/298; 451/527, 533

[56] References Cited

U.S. PATENT DOCUMENTS

| | | | |
|---|---|---|---|
| 5,036,015 | 7/1991 | Sandhu et al. | 437/8 |
| 5,081,796 | 1/1992 | Schultz | 51/165.74 |
| 5,240,552 | 8/1993 | Yu et al. | 156/636 |
| 5,337,015 | 8/1994 | Lustig et al. | 324/671 |
| 5,413,941 | 5/1995 | Koos et al. | 437/8 |
| 5,489,233 | 2/1996 | Cook et al. | 451/41 |

*Primary Examiner*—James C. Cannon
*Attorney, Agent, or Firm*—Kenneth A. Benson

[57] ABSTRACT

A pad is provided for use on a machine for the polishing of silicon wafers which allows the use of optical detection of the wafer surface condition as the wafer is being polished. This accomplished by constructing the entire pad or a portion thereof out of a solid uniform polymer sheet with no intrinsic ability to absorb or transport slurry particles and which is transparent to the light beam being used to detect the wafer surface condition by optical methods. Polymers which are transparent to light having a wavelength within the range of 190 to 3500 nanometers are suitable for the construction of these pads.

8 Claims, No Drawings

POLISHING PADS

BACKGROUND OF THE INVENTION

1. Technical Field

This invention relates to polishing pads used for creating a smooth, ultra-flat surface on such items as glass, semiconductors, dielectric/metal composites and integrated circuits. It particularly relates to the bulk structure of such pads and their ability to allow optical in-situ end point detection during the polishing or planarization process.

2. Background Art

It is desirable to effect planarization of integrated circuit structures in the form of semiconductor wafers during the manufacture of multilayer integrated circuits. The planarization must be very precise, providing a wafer surface that varies from a given plane by as little as a fraction of a micron. This is usually accomplished by CMP, chemical-mechanical polishing, on an apparatus most often comprised of a rotating table, usually circular, onto which is affixed a polishing pad, a wafer carrier which presses the wafer flatly onto the polishing pad, and a means of supplying chemicals and abrasives to the polishing pad in the form of a slurry. Apparatus for polishing thin, flat semiconductor wafers are well known in the art. Such planarization apparatus are manufactured by IPEC Planar, Strausbaugh Manufacturing and the SpeedFam Corporation among others.

A particular problem encountered when planarizing semiconductor wafers on such apparatus is the determination that a wafer has been polished to the desired degree of flatness. Most end-point detection methods shown in the art rely on the change in the surface structure of the wafer as an overlying layer is removed. Thus flatness is not measured, but is only considered secondary to removal of the overlying layer. In U.S. Pat. No. 5,036,015 it is the change in friction between the wafer and the polishing pad which indicates an end-point. In U.S. Pat. No. 5,240,552 the thickness of the wafer is measured by the analysis of reflected acoustic waves. In U.S. Pat. No. 5,337,015 special electrodes underneath the polishing pad along with an electrically grounded polishing table and the use of a conductive slurry allows the dielectric layer thickness to be measured. These devices for in-situ measurement of thickness are very complicated and rely on specialized electronic circuitry to accomplish the task. Most often, instead of using a complicated in-situ method, wafers are removed from the polishing apparatus and flatness is measured using a spectroscopic device to measure the oxide film thickness. Usually, the wafer is taken out of the polishing operation before the expected end point is reached so that excess polishing does not occur. Then the wafer is reinserted into the polishing machine for polishing to the desired endpoint.

U.S. Pat. No. 5,081,796 shows a method and an apparatus for carrying the wafer while on the polishing machine out over the edge of the polishing pad so that a rapid method of measuring the oxide layer, such as laser interferometry, can be used on the underside of the wafer. This method has the disadvantage of removing pan of the wafer from the polishing process at any given time so that the wafer does not receive uniform polishing at all times. This is also true for the optical end point detection method in semiconductor planarizing polishing processes shown in U.S. Pat. No. 5,413,941. It would be very desirable to have a machine upon which such laser light measurements could be employed while the wafer is continuously under total polishing conditions.

SUMMARY OF THE INVENTION

A pad is provided for use on a machine for the polishing of silicon wafers which allows the use of optical detection of the wafer surface condition as it is being polished. This accomplished by constructing the entire pad or a portion thereof out of a solid uniform polymer sheet with no intrinsic ability to absorb or transport slurry particles and which is transparent to the light beam being used to detect the wafer surface condition by optical methods. Polymers which are transparent to light having a wavelength within the range of 190 to 3500 nanometers are suitable for the construction of these pads.

DETAILED DESCRIPTION OF THE INVENTION

There are polishing pads now being used for the polishing of silicon wafers which are made of from a solid uniform polymer sheet. These are described in U.S. patent application Ser. No. 08/224,768, filed Apr. 8, 1994 and now U.S. Pat. No. 5,489,233, which is made part of this specification by reference. The solid uniform polymer sheet has no intrinsic ability to absorb or transport slurry particles. This inability to absorb or transport slurry particles distinguishes the bulk properties of polishing pads made from the solid uniform polymer sheet from the bulk properties of any prior art polishing pads. All prior art pads have a bulk structure which is made up of fibers, contains pores as a result of either being filled with microballoons or blown during manufacturing, or are filled with abrasive. These pads although they might be made from a solid polymer clearly have a bulk structure which is opaque to a beam of light because they are not a uniform structure and will severely scatter any light beam directed onto them. The surface of the polymer sheet useful for the present invention may be provided with both macrogrooves and microgrooves which transform the solid uniform sheet into an excellent polishing pad. As pointed out in the referenced specification, such pads can be made out of any solid uniform polymer including polyurethanes, acrylics, polycarbonates, nylons and polyesters. Since all of these can be made of a polymer which is transparent to light having a wavelength within the range of 190 to 3500 nanometers, pads can be made which allow in situ end-point detection using optical methods such as interferometry.

The transparent pads can be made by any of the methods known to those skilled in the art of making polymer sheet such as casting and extrusion. The polymer may be a thermoplastic material which is heated to a temperature at which it will flow and is then formed by a process such as casting or extrusion. The pad material may be a thermosetting polymer where the reactive ingredients are mixed together and heated in a mold to a temperature at which the mixture sets. If the sheet as cast meets the thickness specifications desired, it may be used as is for the polishing operation. As an alternative, the pad sheet may be sliced out of the polymer as cast.

If one wishes to have just a transparent window in an otherwise opaque pad, a possible method of manufacture would be to cast a rod or a plug of the transparent polymer. This casting can then be inserted in the opaque polymer in its mold while it is still liquid making sure that there is complete contact between the transparent plug and the opaque polymer. After the opaque polymer has set it may be unmolded and sheets for pads with transparent windows may be sliced from the casting.

As shown in U.S. Pat. No. 5,489,223, pads useful for chemical-mechanical polishing of integrated circuit wafers which are made of a polymer sheet which has no intrinsic ability to absorb or transport slurry particles must have in use a surface texture or pattern comprising both large and small flow channels. There will be, therefore, some interference due to the small mount of slurry in these flow channels when one makes in situ optical measurements through a transparent portion of the polishing pad. One can compensate for this interference. Since the slurry in the flow channels is relatively constant, its effect can be nulled out of the signal which is measuring the changes in the wafer surface.

It is also possible for one to insert a window into any of the types of polishing pads which are currently being used for chemical mechanical polishing of integrated circuit wafers. Examples of these types of pads are urethane impregnated polyester felts, microporous urethane pads of the type sold as Politex by Rodel, Inc. of Newark, Del., and filled and/or blown composite urethanes such as IC-series and MH-series polishing pads also manufactured by Rodel, Inc. of Newark, Del. Such pads are not made from a solid uniform polymer sheet which has no intrinsic ability to absorb or transport slurry particles. They are by their pore-containing nature intrinsically capable of slurry transport. A hole could be cut through any of these pads and a plug of solid transparent polymer inserted to act as a window for optical end-point detection. It would be best that the surface of the solid polymer plug have a surface texture or pattern as described in U.S. Pat. No. 5,489,233 so that polishing activity is close to being uniform over the entire polishing pad.

In addition to the polymers previously mentioned (polyurethanes, acrylics, polycarbonates, nylons and polyesters) it is possible to make a transparent window out of polyvinyl chlorides, polyvinylidene fluorides, polyether sulfones, polystyrenes, polyethylenes and polytetrafluoroethylenes. Such windows can be made by casting or extruding the polymer and then curing the polymer to the desired size and thickness.

We claim:

1. A pad useful for polishing integrated circuit wafers, said pad having at least a portion comprised of a solid uniform polymer sheet with no intrinsic ability to absorb or transport slurry particles, said polymer sheet being transparent to light having a wavelength within the range of 190 to 3500 nanometers.

2. A pad according to claim 1 wherein said solid uniform polymer sheet has a surface with a surface texture or pattern comprising both large and small flow channels which together permit the transport of polishing slurry containing particles across said surface, said surface texture or pattern being produced solely by external means upon said surface of said solid uniform polymer sheet.

3. A pad according to claim 1 wherein said pad comprises a first portion comprised of said solid uniform polymer sheet transparent to light and a second portion comprised of a microporous polyurethane structure.

4. A pad according to claim 2 wherein said pad comprises a first portion comprised of said solid uniform polymer sheet transparent to light and a second portion comprised of a microporous polyurethane structure.

5. A pad according to claim 1 wherein said pad comprises a first portion comprised of said solid uniform polymer sheet transparent to light and a second portion comprised of a filled or blown polyurethane structure.

6. A pad according to claim 2 wherein said pad comprises a first portion comprised of said solid uniform polymer sheet transparent to light and a second portion comprised of a filled or blown polyurethane structure.

7. A pad according to claim 1 wherein said pad comprises a first portion comprised of said solid uniform polymer sheet transparent to light and a second portion comprised of a solid uniform polymer sheet with no intrinsic ability to absorb or transport slurry particles, said second portion having a surface with a surface texture or pattern comprising both large and small flow channels which together permit the transport of polishing slurry containing particles across said surface, said surface texture being produced solely by external means upon said surface of said solid uniform polymer sheet.

8. A pad according to claim 2 wherein said pad comprises a first portion comprised of said solid uniform polymer sheet transparent to light and a second portion comprised of a solid uniform polymer sheet with no intrinsic ability to absorb or transport slurry particles; said second portion having a surface with a surface texture or pattern comprising both large and small flow channels which together permit the transport of polishing slurry containing particles across said surface, said surface texture being produced solely by external means upon said surface of said solid uniform polymer sheet.

* * * * *